US005091750A

United States Patent [19]

Yoshida et al.

[11] Patent Number: 5,091,750

[45] Date of Patent: Feb. 25, 1992

[54] CARTRIDGE UNIT

[75] Inventors: Seitaro Yoshida, Osaka; Kenichi Ashida, Nishinomiya, both of Japan

[73] Assignee: Mita Industrial Co., Ltd., Osaka, Japan

[21] Appl. No.: 622,526

[22] Filed: Dec. 5, 1990

[30] Foreign Application Priority Data

Dec. 8, 1989 [JP] Japan ..... 1-320234

[51] Int. Cl.[5] ..... G03G 15/06

[52] U.S. Cl. ..... 355/260; 141/364; 141/366

[58] Field of Search ..... 206/527, 631; 141/346, 141/348, 363, 364, 365, 366, 383, 386; 355/215, 245, 260; 220/346; 333/DIG. 1

[56] References Cited

FOREIGN PATENT DOCUMENTS 0371520 6/1990 United Kingdom ..... 355/260

*Primary Examiner*—A. T. Grimley
*Assistant Examiner*—Patrick J. Stanzione
*Attorney, Agent, or Firm*—Beveridge, DeGrandi & Weilacher

[57] ABSTRACT

A toner cartridge unit for a copying machine having a double shutter at the mouth of the toner cartridge. The double shutter is locked when the cartridge is not attached to a toner hopper of the copying machine and prevents toner from coming out. Owing to the double shutter structure, the outside of the cartridge is always clean. When the cartridge unit is attached to the hopper, many locking and releasing mechanisms for the double shutter and a third shutter provided at the hopper entrance work sequentially and automatically as the cartridge is moved from a preparation site to a supplying site of the toner hopper.

29 Claims, 12 Drawing Sheets

103
103a
103b
103c
103d
103e
103f
105
106
107
107a
107b
108
10
101
102
104
S
103d1
103d2
103d3
103d

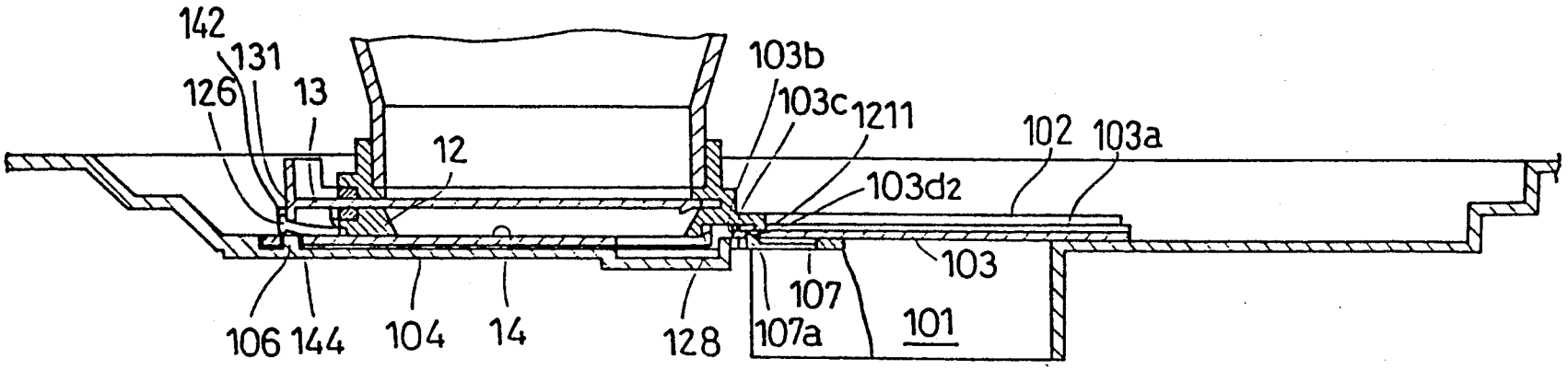
FIG. 9A
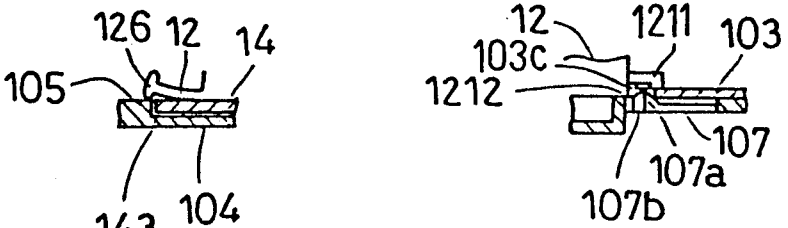
FIG. 9B
FIG. 9C
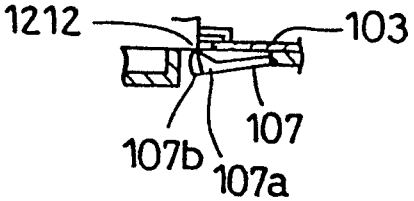
FIG. 9D

CARTRIDGE UNIT

BACKGROUND OF THE INVENTION

The present invention relates to a cartridge unit for containing toner powder and adapted to a developer of a copying machine etc. to supply toner powder.

One type of conventional toner cartridges is shown in the Japanese Published Unexamined Utility Model Application No. S60-145452, whose structure is illustrated in FIG. 15A. The mouth of the toner cartridge 201 is closed by a seal member 202, and an extension of the seal member 202 is folded back. When the toner cartridge 201 is attached to a toner hopper 203, the end of the extension is hooked by a pin 204 provided near the entrance of the toner hopper 3, as shown in FIG. 15B. As the cartridge 201 is pushed down the entrance of the toner hopper 203, the seal member 202 is deprived from the mouth and the toner powder in the cartridge 201 falls down to the toner hopper 203.

Another example is shown in the Japanese Published Unexamined Utility Model Application No. S59-9364, whose structure is illustrated in FIG. 16A. In this case, the mouth of a toner cartridge 205 is sealed by a plug 208. The toner cartridge 205 is attached to the toner hopper 207 by a male screw 206 formed on the outside surface of the cartridge body and a female screw formed on the inside surface of the entrance of the toner hopper 207. On a shelf provided at a midway of the hopper entrance stands a thrust rod 209. As the cartridge body is screwed down the entrance of the hopper 207, the thrust rod 209 pushes up the plug 208 and opens the mouth.

In any case, once the seal of the mouth of conventional toner cartridges is broken, the seal cannot recover the mouth. One problem is that when the toner powder in the cartridge is finished and the cartridge is removed from the toner hopper, the mouth is open and the remnant powder scatters. Another problem is that an operator can easily break the seal member 202 or push the plug 208 outside the hopper 203, 207 by mistake. The problem is more serious in this case.

SUMMARY OF THE INVENTION

An object of the present invention is to solve such problems and provide a cartridge unit that can assuredly contain powder (e.g., toner powder for a copying machine, etc.) and prevents unintentional spill-out of the powder.

Another object of the present invention is to provide a shutter for the cartridge that surely locks while the cartridge is not attached to a powder receiver (such as a toner hopper) but is easily and automatically released when the cartridge is attached to the powder receiver.

Still another object of the present invention is to keep the outside of the cartridge unit always clean even after the cartridge is used to supply toner powder to the toner hopper.

These and other objects of the present invention are achieved by the cartridge unit of the present invention which comprises:

a cartridge for containing powder and having a mouth through which the powder is supplied;

an adapter fixed to the mouth of the cartridge and having a hole through which the powder is supplied and a slit engraved from a side end of the adapter across the hole, the adapter being attachable to the powder receiver;

an inner shutter that can be inserted in the slit of the adapter for shutting the hole; and an outer shutter that can be attached on the outside of the adapter for covering the hole of the adapter.

Many other features of the present invention is revealed in detail in the following description of an embodiment.

BRIEF DESCRIPTION OF THE ATTACHED DRAWINGS

FIG. 9A is a cross-sectional view of the hopper entrance and the cartridge/adapter unit when the unit is placed on the preparation site, FIG. 9B shows the detail of a hook 126 and a table 105 when the hook 126 is pushed up by the table 105, FIG. 9C shows the detail of a leader 1212, claw 107 and a notch when the claw 107 engages with the notch, and FIG. 9D shows the detail when the claw 107 is pushed down by the leader 1212 and is disengaged from the notch.

Figure 10:
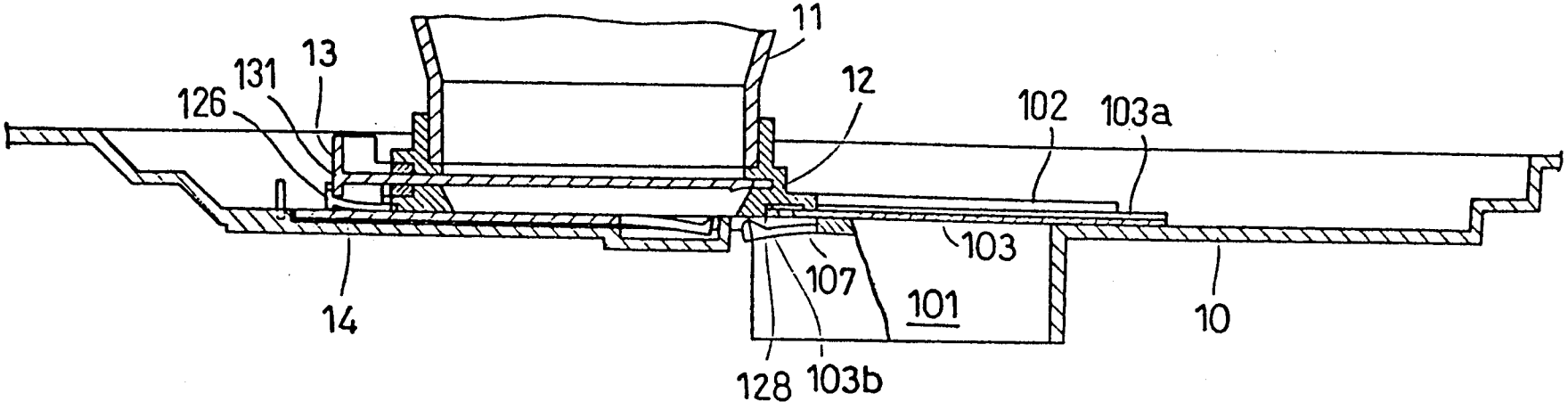

FIG. 10 is a cross-sectional view of the hopper entrance and the cartridge/adapter unit when the unit is being moved from the preparation site to the supplying site.

Figure 11:
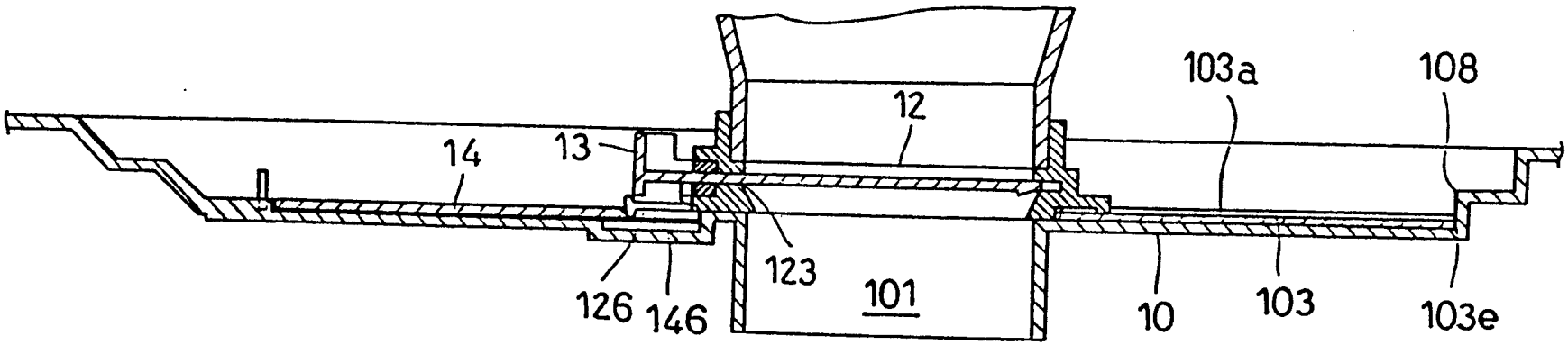

FIG. 11 is a cross-sectional view of the hopper entrance and the cartridge/adapter unit when the unit is placed at the supplying site.

Figure 12:
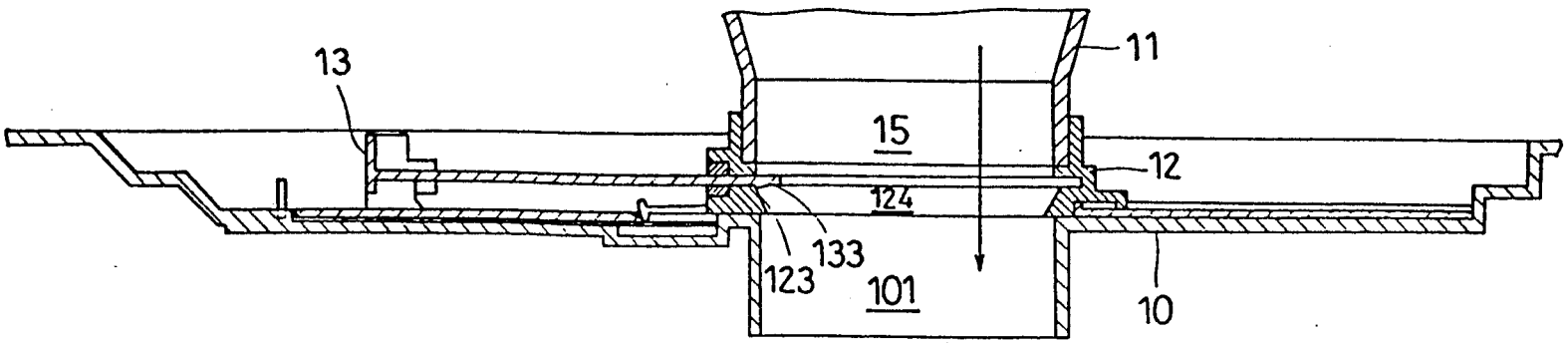

FIG. 12 is a cross-sectional view of the hopper entrance and the cartridge/adapter unit when the unit is placed at the supplying site and the inner shutter is drawn out to supply toner powder to the toner hopper.

Figure 13A:
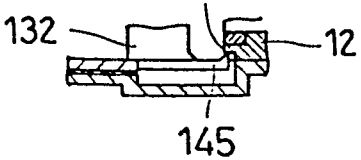
Figure 13B:
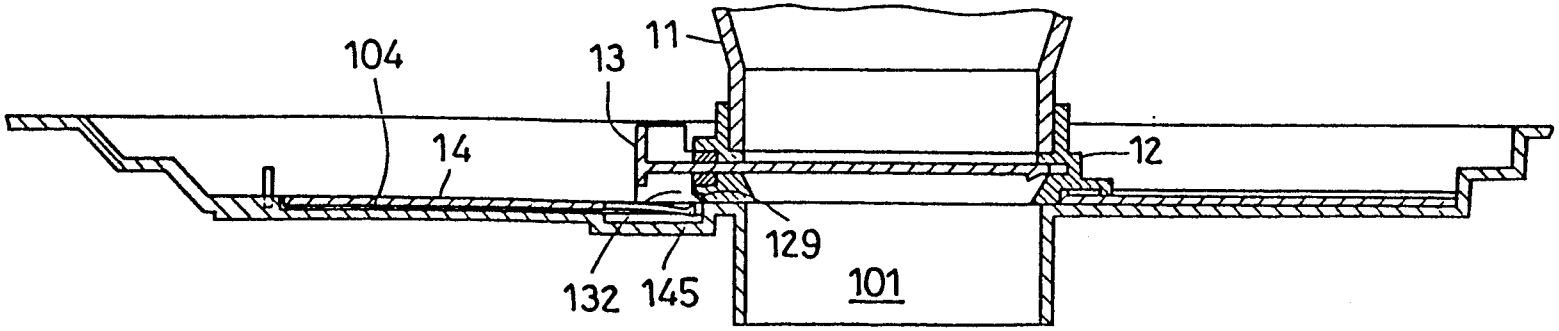

FIG. 13A shows the detail of a cantilever 145, foot 132 and recess 129 when the cantilever 145 engages with the recess 129, and FIG. 13B is a cross-sectional view of the hopper entrance and the cartridge/adapter unit when the unit is placed at the supplying site and the inner shutter returns to the shutting position.

Figure 14A:
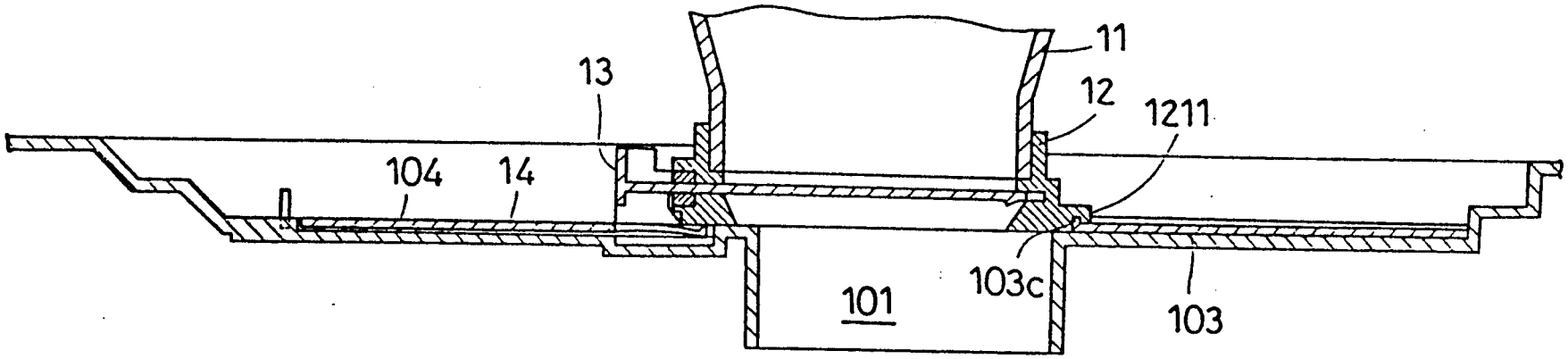
Figure 14B:
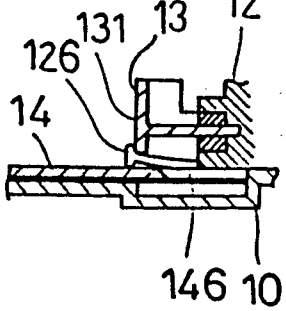

FIG. 14A is a cross-sectional view of the hopper entrance and the cartridge/adapter unit when the unit is being moved from the supplying site to the preparation site, and FIG. 14B shows the detail of a handle of the inner shutter 13, the hook 126 and a rear notch 146 when the hook 126 locks the inner shutter 13.

Figure 15A:
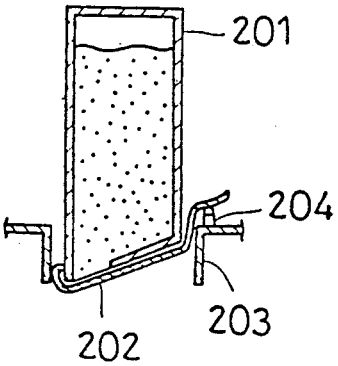
Figure 15B:
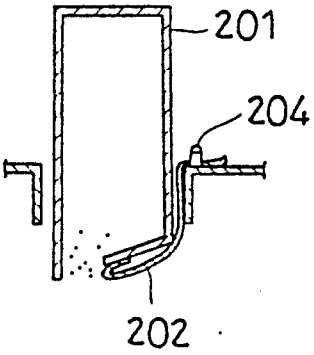

FIG. 15A is a cross-sectional view of a conventional toner cartridge before the seal is broken, and FIG. 15B shows after the seal is broken.

Figure 16A:
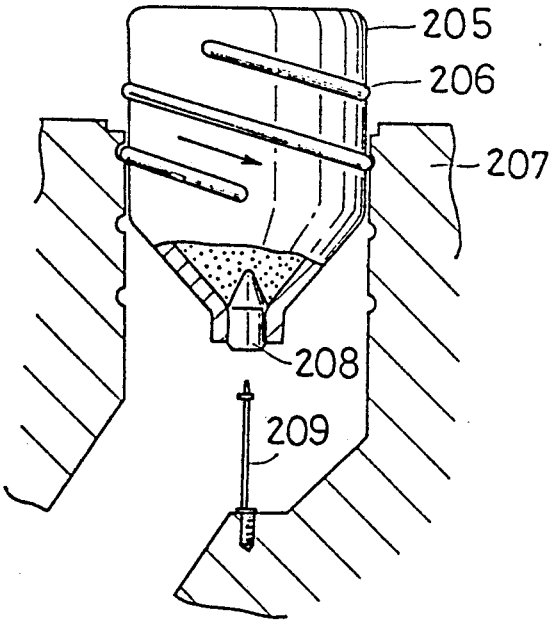
Figure 16B:
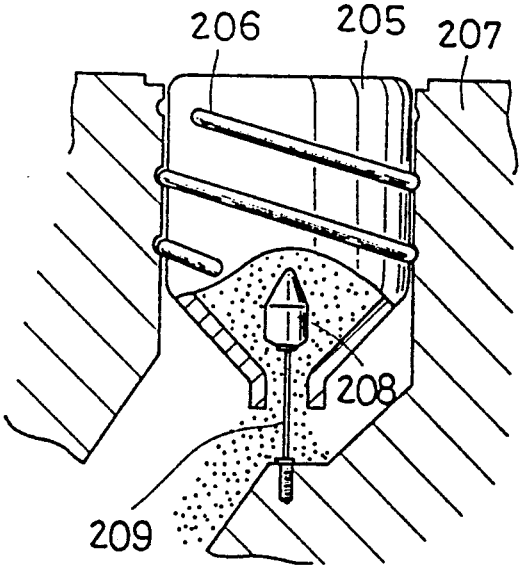

FIG. 16A is a cross-sectional view of another conventional toner cartridge before it is completely attached to the toner hopper, and FIG. 16B shows after it is completely attached.

DETAILED DESCRIPTION OF THE PREFERRED EMBODIMENTS

Figure 1:
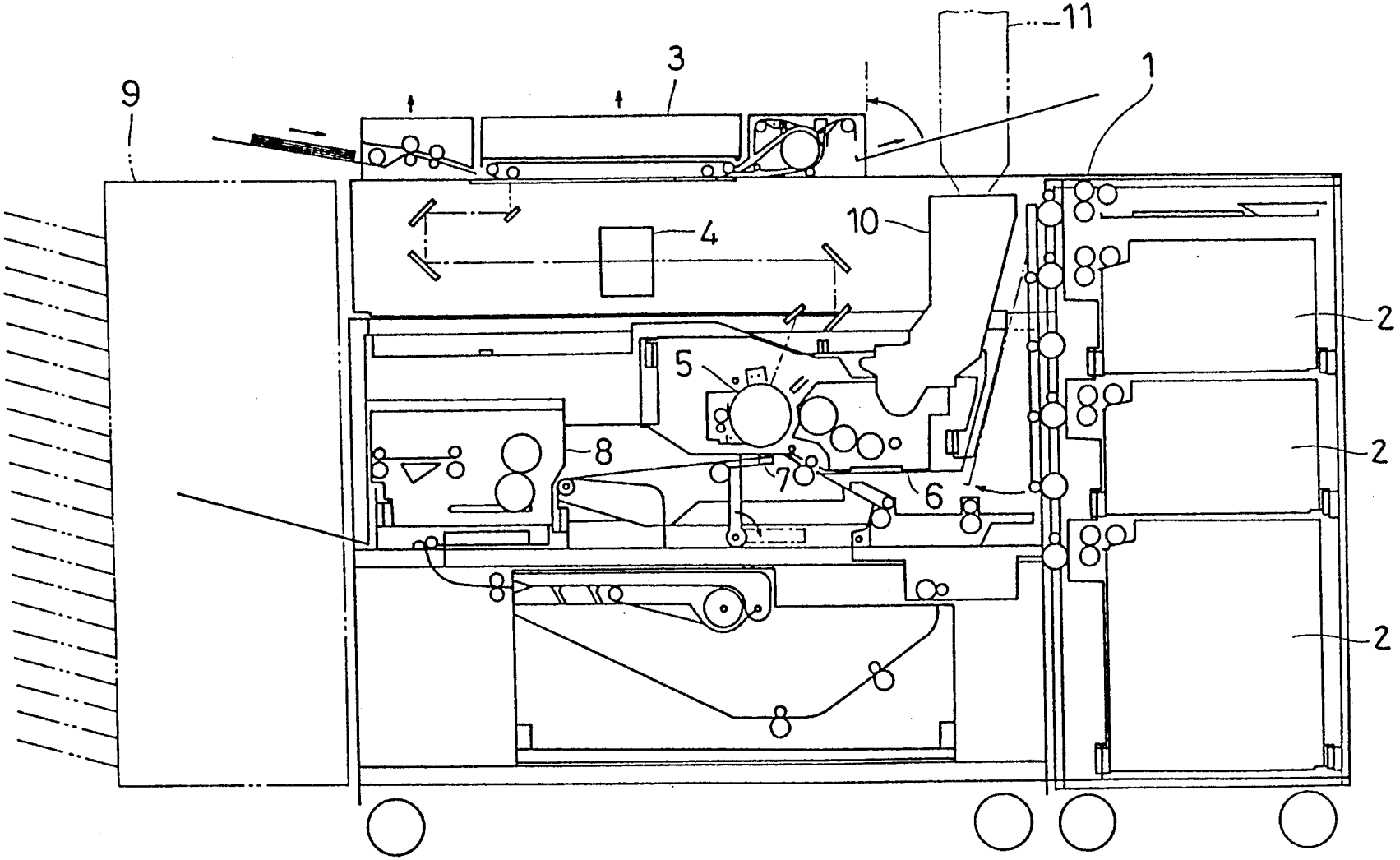
FIG. 1 is an inside view of a copying machine that a toner cartridge as an embodiment of the present invention is attached.

An embodiment of the toner cartridge unit of the present invention is used in a copying machine as shown in FIG. 1. The copying machine is equipped with: an automatic document handler 3 on the top of the housing 1; a paper supplier boxes 2 at the right side of the housing 1; and a sorter 9 at the left side of the housing 1. Inside of the housing 1 is provided: an optical system 4 for reading an original; a photoconductive drum 5 for producing an electrostatic latent image of the original; a developer unit 6 for developing the latent image into a toner powder image; a transferor 7 for transferring the toner image on the drum 5 to a sheet of paper; and a fuser 8 for heat-fixing the toner image on the paper sheet.

Figures 2A, 2B, 2C, 2D:
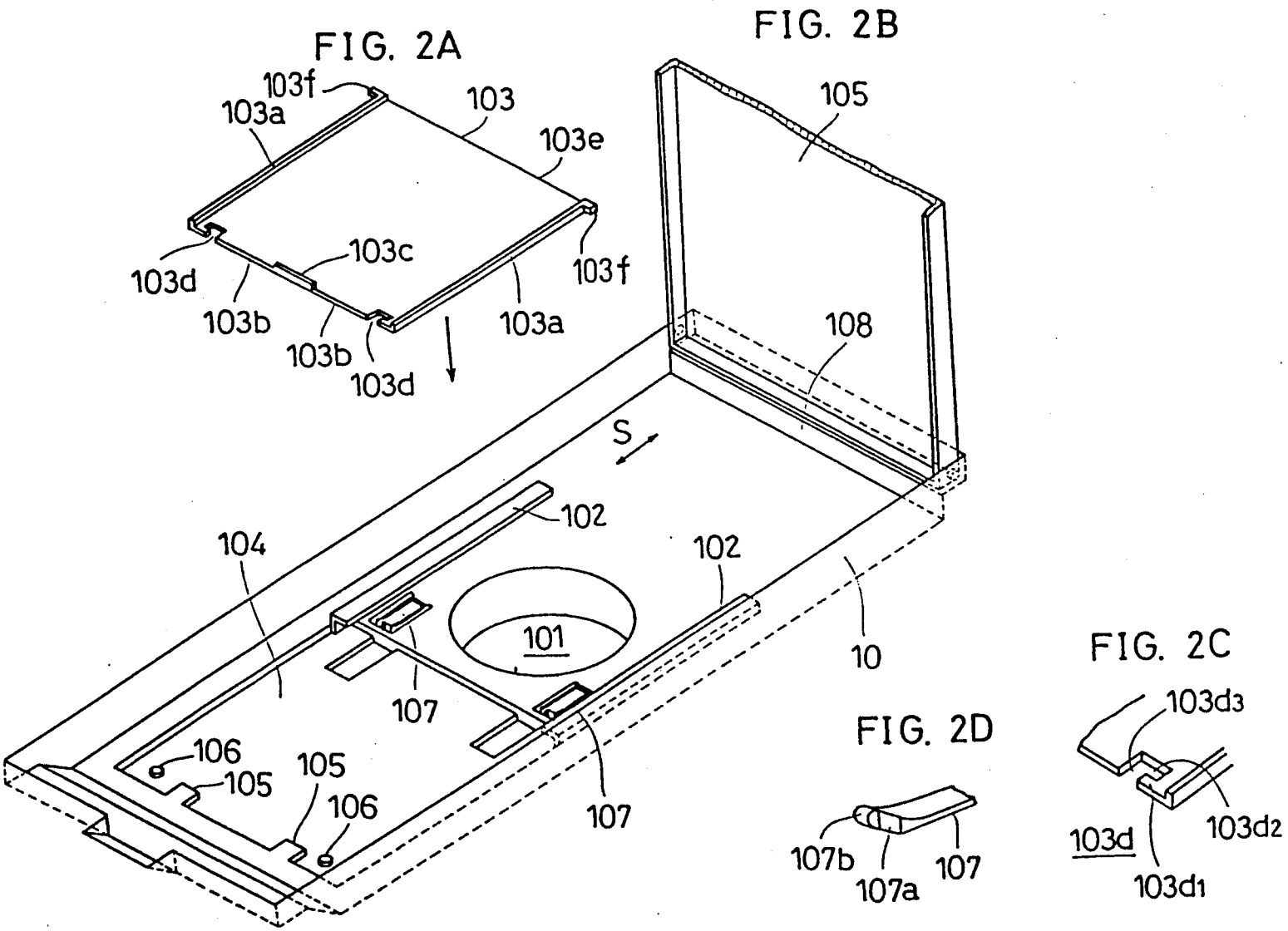
FIG. 2A is a perspective view of a hopper shutter.
FIG. 2B is a perspective view of the entrance of the toner hopper of the copying machine, FIG. 2C show the detail of a notch formed at the front end of the hopper shutter shown in FIG. 2A, and FIG. 2D show the detail of a claw placed on a supplying site of the toner hopper entrance shown in FIG. 2B.

A toner hopper 10 is provided above the developer unit 6 to supply toner powder to the developer unit 6. The toner hopper 10 is high enough to reach the upper deck of the housing 1. FIG. 2B shows the entrance of the toner hopper 10. A circular hole 101 at the center of the hopper entrance is for admitting the toner powder. At either side of the hole 101 is provided a guide rail 102 (an embodiment of the tenth member) whose cross section is inverse-L shaped. A hopper shutter 103 as shown in FIG. 2A slides on the guide rails 102 to shut the hole 101. A stiff edge 103*a* is formed at either lateral edge of the shutter 103 to slide on the rail 102 and the shutter 103 moves as shown by the arrow S. At the front (left in FIG. 2B) end of the hopper entrance is provided a preparation site 104 for initially attaching a toner cartridge before sliding the cartridge to the hole 101. The whole hopper entrance is normally closed by a cover 105. The above-mentioned members are made of plastics.

Figure 3:
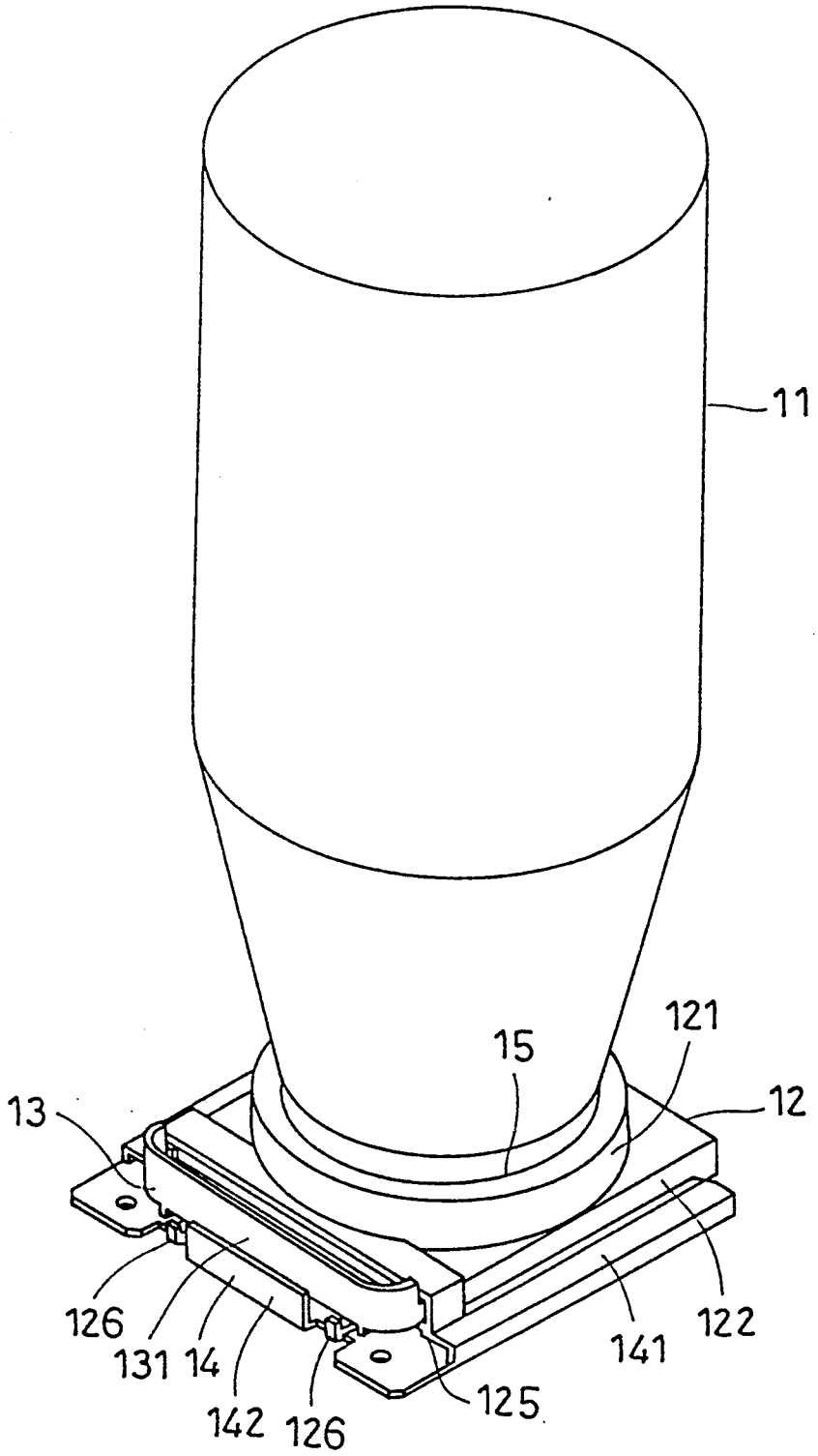
FIG. 3 is a perspective view of the toner cartridge with an adapter.
Figure 4A:
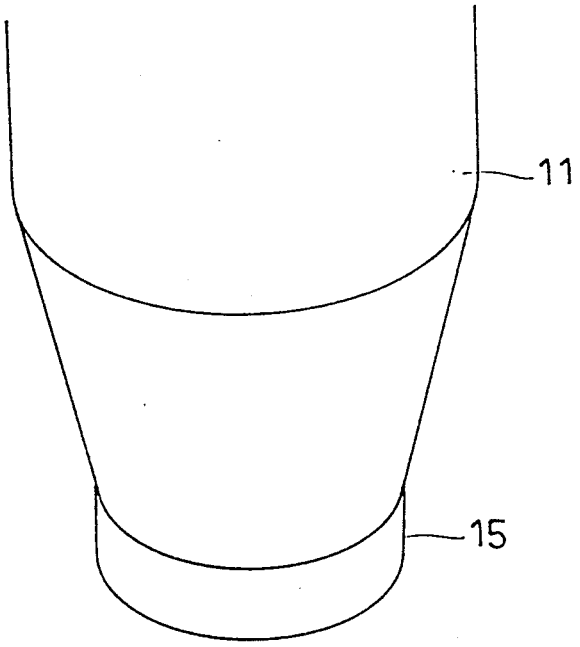
FIG. 4A is a perspective view of the toner cartridge.
Figure 4B:
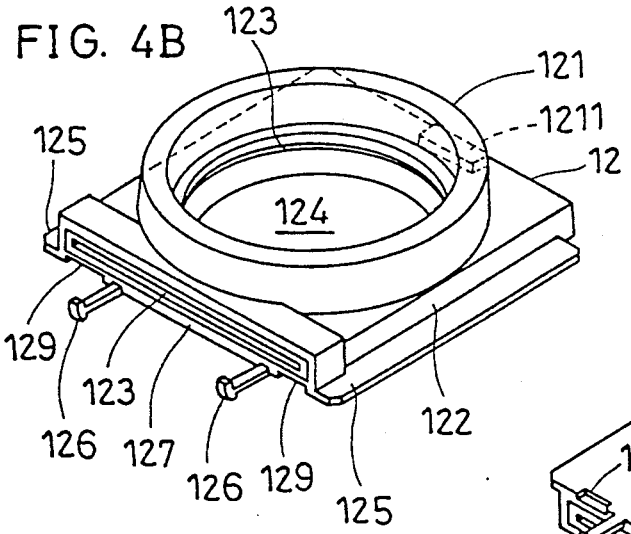
FIG. 4B is a perspective view of the adapter as detached from the cartridge.

The toner cartridge adaptable to the toner hopper 10 is shown in FIG. 3. The toner cartridge 11 is shaped cylindrical with the mouth 15 at the bottom, and an adapter 12 is attached around the mouth 15. As shown in FIGS. 4A and 4B, a ring 121 is formed on a base plate 122 of the adapter 12, and the mouth 15 of the cartridge 11 is forcefully inserted into the ring 121. Instead of the friction fixture, the mouth 15 and the adapter 12 can be fixed by a screw. At the center of the rectangular base plate 122 is formed a hole 124. The diameter of the hole 124 is the same as the inner diameter of the ring 121. At the center of the thickness of the base plate 122 is formed a slit 123, and the slit 123 opens at the periphery of the hole 124 and at one end (front end) 127 of the base plate 122. Side extensions 125 (each is an embodiment of the eighth member) are formed at opposing lateral ends of the rectangular base plate 122 for sliding on the guide rails 102.

Figure 5:
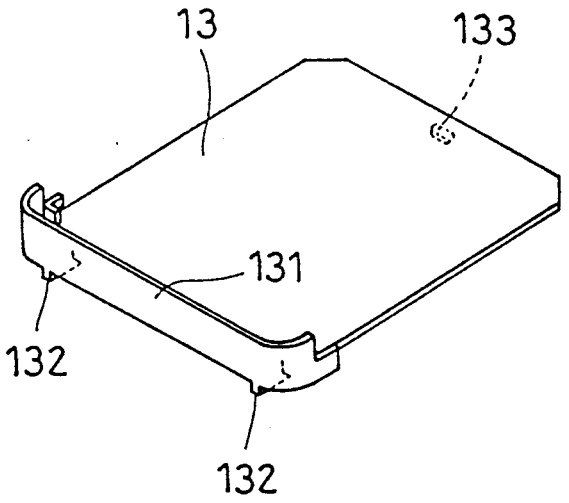
FIG. 5 is a perspective view of an inner shutter of the adapter.
Figure 6:
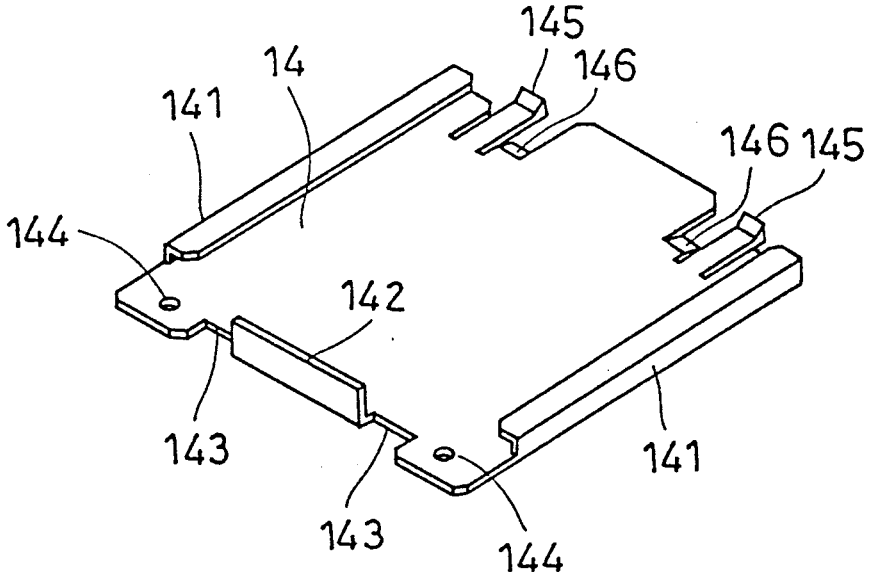
FIG. 6 is a perspective view of an outer shutter of the adapter.

In the slit 123 of the base plate 122 is inserted an inner shutter 13 as shown in FIG. 5 to shut the hole 124 of the adapter 12. Besides the inner shutter 13, an outer shutter 14 as shown in FIG. 6 is provided for the adapter 12. At either lateral edge of the outer shutter 14 is formed a guide rail 141 (an embodiment of the ninth member) for admitting each of the side extensions 125. The outer shutter 14 is normally attached to the adapter 12 with the guide rails 141 engaged with the side extensions 125 (FIG. 3). The inner shutter 13 and the outer shutter 14 both shut the hole 124 of the adapter 12 and prevent toner powder from coming out of the cartridge 11. As shown in FIG. 5, a handle 131 (an embodiment of the first member) is formed at the front end of the inner shutter 13 for facilitate the handling of the inner shutter 13. Similarly, a handle 142 (an embodiment of the second member) is formed at the front end of the outer shutter 14. The height of the plate-like handle 142 of the outer shutter 14 is designed high enough so that the handel 142 of the outer shutter 14 pushes the handle 131 of the inner shutter 13 when the outer shutter 14 is slid on the side extensions 125 of the base plate 122 to shut the hole 124 (FIG. 3).

From the front end of the base plate 122 project two T-shaped hooks 126 (each is an embodiment of the third member). The hooks 126 are vertically resilient. At the front end of the outer shutter 14 (and at the sides of the handle 142) are formed front notches 143 (each is an embodiment of the fourth member), and at the other (rear) end of the outer shutter are formed rear notches 146 (each is an embodiment of the sixteenth member). At the end of each of the rear notches 146 is formed a slope. The position of the front notches 143 and the rear notches 146 of the outer shutter 14 correspond to the hooks 126 of the base plate 122. When the adapter 12 is slid on the outer shutter 14 to shut or open the hole 124, the slopes of the rear notches 146 facilitates the lower edge of the T-shaped hooks 126 to ride on or off the outer shutter 14. When the outer shutter 14 completely shuts the hole 124, the lower edge of the T-shaped hook 126 engages with each of the front notches 143, thus the outer shutter 14 is locked on the adapter 12.

As shown in FIG. 2B, two low circular protrusions 106 (each is an embodiment of the sixth member) are formed on the floor of the front preparation site 104. At the corresponding places of the outer shutter 14 are formed circular holes 144 (each is an embodiment of the fifth member) for admitting the protrusions 106. When the adapter 12 with the outer shutter 14 is placed on the preparation site 104, the outer shutter 14 alone is arrested by the protrusions 106. At the front end of the preparation site 104 are formed two rectangular tables 105 (each is an embodiment of the seventh member) corresponding to the front notches 143 of the outer shutter 14. The height of the tables 105 are larger than the thickness of the plate of the outer shutter 14, so that the hooks 126 are pushed up by the tables 105 and is disengaged from the front notches 143 when the adapter 12 with the outer shutter 14 is placed on the preparation site 104. The outer shutter 14 and the corresponding members are so designed that only the outer shutter 14 is left on the preparation site 104 when the cartridge 11 and the adapter 12 (cartridge/adapter unit) are pushed toward the hole 101. When the cartridge/adapter unit is placed above the hole 101 (supplying site), the handle 131 of the inner shutter 13 is released from the handle 142 of the outer shutter 14 and the inner shutter 13 can be drawn out of the slit 123.

Figure 4C:
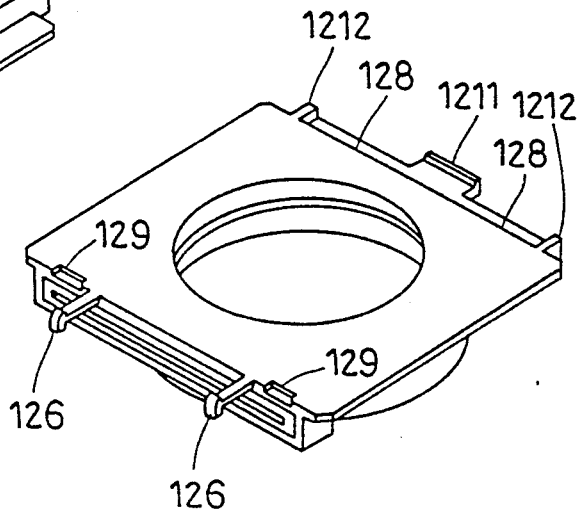
FIG. 4C is a perspective view of the reverse side of the adapter shown in FIG. 4B.

As shown in FIG. 2A, a thick end 103*b* is formed at the front end of the hopper shutter 103. At the rear end of the lower surface of the base plate 122 of the adapter 12 is formed a recess 128 (an embodiment of the sixteenth member) (FIG. 4C). When the cartridge/adapter unit is placed on the preparation site 104, the recess 128 fits the thick end 103*b* of the hopper shutter 103 closing the hole 101. When the adapter 12 is slid toward the hole 101, the edge of the recess 128 pushes the thick end 103*b* and so the hopper shutter 103 opens the hole 101 (FIG. 10).

As shown in FIG. 5, two feet 132 (each is an embodiment of the nineteenth member) are formed at the front end of the inner shutter 13. At the rear end of the outer shutter 14 corresponding to the positions of the feet 132 are formed two vertically resilient cantilevers 145 (each is an embodiment of the seventeenth member) whose ends rise up with slopes to the front side (FIG. 6). At the front end of the lower surface of the base plate 122 of the adapter 12 are formed two recesses 129 (embodiments of the eighteenth member) corresponding to the positions of the rising up ends of the cantilevers 145 (FIGS. 4B and 4C). As shown in FIG. 13B, when the cartridge/adapter unit is placed just above the hole 101 and the inner shutter 13 completely inserted in the slit 123, the feet 132 of the inner shutter 13 pushes down the cantilevers 145 of the outer shutter 14 and disengages the cantilevers 145 from the recesses 129 of the base plate 122. When the inner shutter 13 is drawn out of the slit 123, the feet 132 no more pushes down the cantilevers 145 and the cantilevers 145 return to the straight position to engage with the recesses 129 of the base plate 122 of the adapter 12. This prevents the base plate 122 (so the adapter 12 and the cartridge 11) from being dragged to the preparation site 104 when the inner shutter 13 is drawn out of the slit 123, and the cartridge 11 assuredly remains above the hole 101. On the other hand, when the inner shutter 13 is completely inserted in the slit 123, the cantilevers 145 are pushed down and the base plate 122 (so the adapter 12 and the cartridge 11) can be moved to the preparation site 104.

Figure 7:
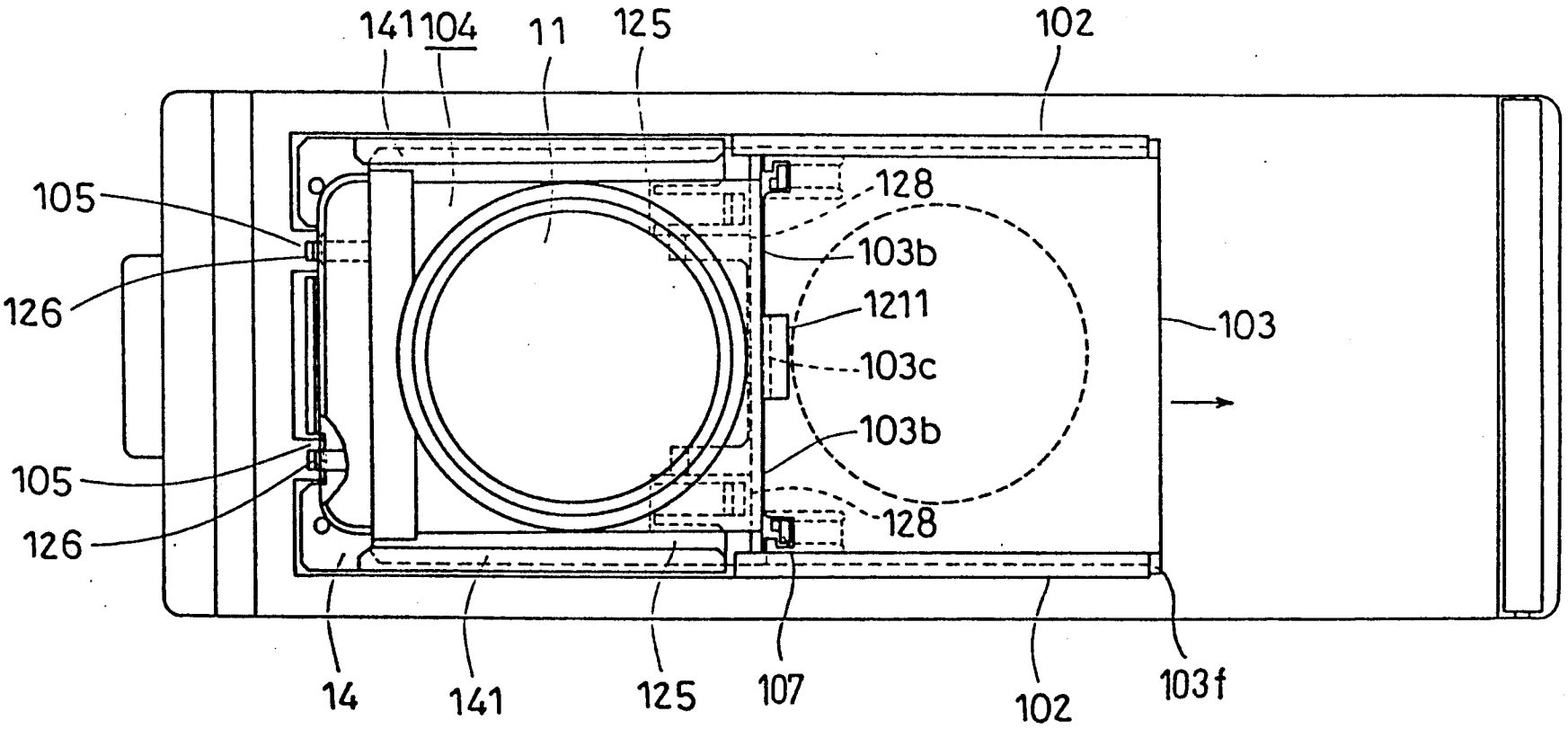
FIG. 7 is a plan view of the hopper entrance as the cartridge/adapter unit is placed at a preparation site.

As shown in FIG. 2A, an angle 103*c* (an embodiment of the fifteenth member and the 24th member) is formed at the center of the front end of the hopper shutter 103. Corresponding to that, as shown in FIGS. 4B and 4C, an angle 1211 (an embodiment of the fourteenth member and the 23rd member) is formed at the rear end of the back surface of the adapter 12. When the adapter 12 is placed at the preparation site 104, the angle 1211 of the adapter 12 comes to the rear of the angle 103*c* of the hopper shutter 103, as shown in FIG. 7. Thus, when the adapter 12 is moved from the site of the hole 101 (supplying site) to the preparation site 104, the angle 1211 of the adapter 12 pulls the hopper shutter 103 by the angle 103*c* to shut the hole 101. At each side corner of the rear end of the hopper shutter 103 is formed a hook 103*f* which engages with one of the guide rails 102 to stop the hopper shutter 103 just above the hole 101 when the hopper shutter 103 is pulled by the adapter 12.

As shown in FIG. 5, a protrusion 133 is formed at the rear end of the inner shutter 13 in order to prevent the inner shutter 13 from falling off the slit 123.

As shown in FIG. 2A, a notch 103*d* (an embodiment of the eleventh member and the 20th member) is formed at either corner of the front end of the hopper shutter 103, which is detailed in FIG. 2C. The notch 103*d* is shaped rectangular with a small peninsula 103*d*1, forming an L-shaped notch with an outer notch 103*d*3 and an inner notch 103*d*2. Corresponding to each of the notches 103*d*, a vertically resilient claw 107 (an embodiment of the twelfth member and the 21st member) is formed at a rather front end and inside of each guide rail 102 on the upper surface of the hopper 10, as shown in FIG. 2B. The claw 107 is detailed in FIG. 2D, in which the free end of the claw 107 rises upward, and half 107*a* of the free end is straight-cut and the other half 107*b* is round. The straight-cut half 107*a* engages with the inner notch 103*d*2 of the hopper shutter 103 and prevents the shutter 103 from moving rearward when the shutter 103 completely shuts the hole 101. Corresponding to each of the claws 107, a leader 1212 (an embodiment of the thirteenth member and the 22nd member) is formed at the rear end of the undersurface of the adapter 12. When the adapter 12 is pushed rearward toward the hole 101, the leaders 1212 push down the round half 107*b* part of the claws 107 and releases the hopper shutter 103 to be pushed rearward by the adapter 12.

The operation of embodiment is now described. The cross-sectional figures in FIG. 8 etc. are not necessarily taken on the same line. First, a toner cartridge 11 as shown in FIG. 2A is fixed to the adapter 12 as shown in FIG. 2B. Then the inner shutter 13 is inserted in the slit 123 of the base plate 122 of the adapter 12, and the outer shutter 14 is attached to the adapter 12 with the guide rails 141 fit on the side extensions 125. When the outer shutter 14 is completely attached to the adapter 12, the hooks 126 engage with the front notches 143 of the outer shutter 14 and the outer shutter 14 is locked on the adapter 12. Since the handle 142 of the outer shutter 14 restricts the handle 131 of the inner shutter 13, the inner shutter 13 is also locked on the adapter 12. These shutter locking mechanisms of the adapter 12 assuredly prevents the toner from mistakenly spilling out of the cartridge 11.

Figure 8:
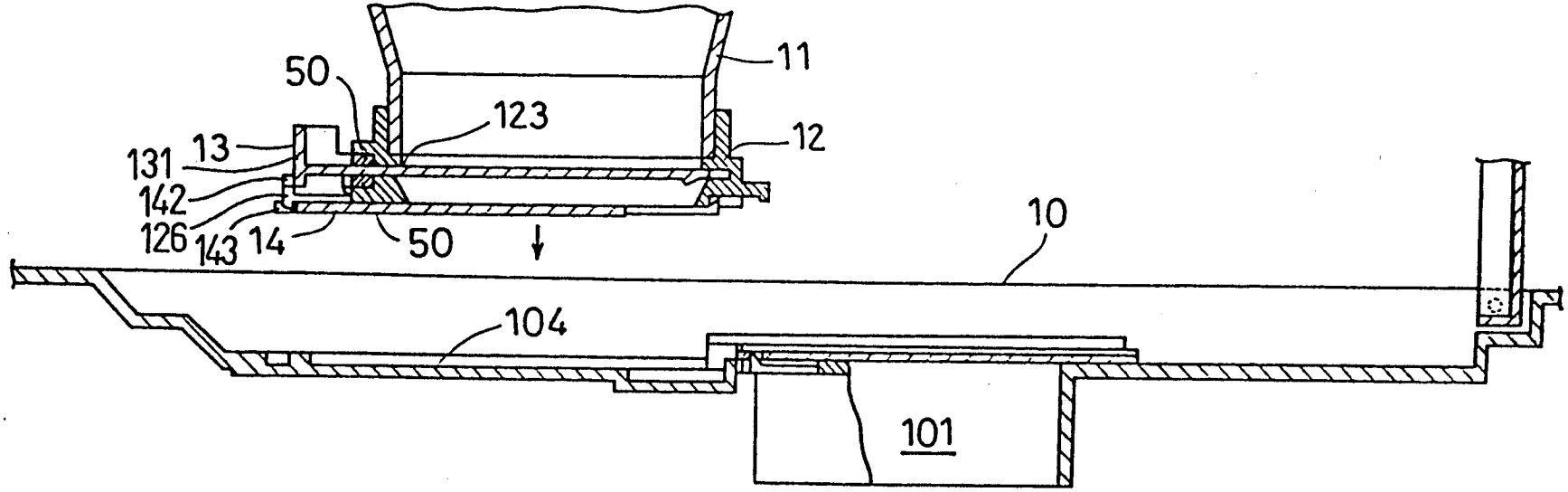
FIG. 8 is a cross-sectional view of the hopper entrance and the cartridge/adapter unit before the unit is placed on the preparation site.

Then, as shown in FIG. 8, the toner cartridge/adapter unit is placed on the preparation site 104 of the toner hopper 10. Sponge sealant 50 is shown in FIG. 8 for completely sealing the gap between the mouth of the slit 123 and the inner shutter 13. The adapter 12 is placed at a preset appropriate position on the preparation site 104 with the protrusions 106 on the floor of the preparation site 104 adapted in the holes 144 of the outer shutter 14. At this position of the adapter 12, the angle 1211 at the rear end of the adapter 12 comes to the rear of the front end angle 103*c* of the hopper shutter 103, and the recess 128 of the base plate 122 of the adapter 12 comes to the front of the thick front end 103*b* of the hopper shutter 103.

As shown in FIG. 9B in detail, when the adapter 12 is correctly placed, the hooks 126 of the adapter 12 are pushed upward by the tables 105 and the outer shutter 14 is released from the hooks 126. Further, as shown in FIG. 9A, the other arms of the T-shaped hooks 126 stop the handle 131 of the inner shutter 13 when the hooks 126 are pushed upward by the tables 105. While the cartridge/adapter unit is being pushed rearward, the hooks 126 slide on the surface of the outer shutter 14 and the inner shutter 13 keeps locking the hole 124.

At this position (i.e., at the preparation site 104) of the adapter 12, the straight-cut half ends 107*a* of the claws 107 engage with the inner notch 103*d*2 of the hopper shutter 103 and the shutter 103 is locked above the hole 101 of the hopper 10 (FIGS. 2C, 2D and 7). The other round half ends 107*b* rise up from the level of the hopper shutter 103 through the outer notch 103*d*3 (FIGS. 2C and 2D).

Then the operator pushes the toner cartridge 11 rearward to the hole 101. As the adapter 12 moves rearward, the leaders 1211 of the base plate 122 push down the round half ends 107*b*, as shown in FIGS. 9C and 9D, and the straight-cut half ends 107*a* are released from the inner notch 103*d*2. Thus the hopper shutter 103 is released and become movable.

As shown in FIG. 10, as the toner cartridge 11 is pushed rearward, the edge of the recess 128 pushes the thick front end 103*b* of the hopper shutter 103 and the hopper shutter 103 opens the hole 101. While the toner cartridge 11 is pushed at a rather high position, the cartridge 11 does not fall rearward because the side extensions 125 are guided by the guide rails 102 (FIGS. 2B and 4B).

When the cartridge 11 is further pushed and the rear end 103*e* of the hopper shutter 103 abuts the rear end 108 of the hopper entrance, the adapter 12 comes just above the hole 101 of the hopper 10. At this position of the adapter 12, the hooks 126 fall in the rear notches 146 of the outer shutter remaining on the preparation site 104 and the handle 131 of the inner shutter 13 is released from the hooks 126.

Then the inner shutter 13 is drawn out of the slit 123. As shown in FIGS. 13A and 13B, when the inner shutter 13 is drawn slightly forward, the feet 132 at the front end of the inner shutter 13 release the cantilevers 145 of the outer shutter 14. The cantilevers 145 rise up and the tip come in the recesses 129 of the front end of the base plate 122 of the adapter 12. This prevents the adapter 12 and the toner cartridge 11 from being dragged forward as the inner shutter 13 is drawn out of the slit 123.

As shown in FIG. 12, the toner powder in the cartridge 11 falls down to the hopper 10 when the inner shutter 13 clears the hole 124 of the adapter 12. The inner shutter 13 cannot be removed from the slit 123 because of the protrusion 133.

After the cartridge-load of the toner powder is supplied to the developer unit 6, the inner shutter 13 is pushed to shut the hole 124 of the adapter 12, as shown in FIG. 13B. As the inner shutter 13 shuts the hole 124, the feet 132 of the inner shutter 13 push down the cantilevers 145 of the outer shutter 14. This releases the recesses 129 from the rising up tips of the cantilevers 145, and the cartridge/adapter unit can be moved forward.

After the inner shutter 13 is completely inserted in the slit 123, the cartridge/adapter unit is moved toward the preparation site 104. While the adapter 12 is moved this way, the angle 1211 of the adapter 12 pulls the hopper shutter 103 by the angle 103*c*. When the adapter 12 is placed just at the preset preparation site 104, the hopper shutter 103 completely shuts the hole 101 of the hopper 10. Thus no toner powder comes out of the hopper 10 and the environment of the copying machine is kept clean, and dusts are prevented from coming in the developer unit 6. Further, when the adapter 12 is moved forward, the hooks 126 of the adapter 12 slide up the slopes of the rear notches 146 and ride on the level of the outer shutter 14, which locks the inner shutter 13.

When the cartridge/adapter unit is correctly placed on the preparation site 104, as shown in FIGS. 7 and 9A, the side extensions 125 of the adapter 12 are out of the guide rails 102 and the cartridge/adapter unit can be lifted from the preparation site 104 of the hopper 10. When the cartridge 11 and the adapter 12 is lifted, the outer shutter 14 is also lifted because the guide rails 141 of the outer shutter 14 engages with the side extensions 125. When the adapter 12 is lifted, the hooks 126 that have been pushed upward by the tables 105 become straight and the outer shutter 14 is locked by the hooks 126 and the front notches 143. The inner shutter 13 is also locked by handle 142 of the outer shutter 14. Thus, there is no opening of the inner and outer shutters 13 and 14 of the cartridge/adapter unit when it is removed from the hopper 10.

Since the outer shutter 14 stays on the preparation site 104 while the toner is supplied from the cartridge 11 to the developer unit 6, the outer shutter 14 is free from the contamination of the toner powder. Thus the cartridge/adapter unit is always clean. In the embodiment, it is preferable to make resilient members, such as the hooks 126 etc., from elastic plastics.

As described above, the mouth 15 of the toner cartridge 11 is shut by the inner shutter 13 and the outer shutter 14, and the shutters 13 and 14 are locked to the adapter 12 when the cartridge/adapter unit is not attached to the hopper 10. Since the outer shutter 14 cannot be contaminated by toner powders when the toner powder is supplied from the cartridge 11 to the hopper 10 of the developer unit 6, the cartridge/adapter unit is always clean and does not contaminate the operator or the environment of the copying machine. The locking/releasing mechanisms of the shutters 13, 14 and 103 are dexterously designed in the present invention so that sequential locking/releasing operations are performed automatically and erroneous operations can be prevented. For example, when the cartridge/adapter unit is not attached to the hopper 10, the inner shutter 13 and outer shutter 14 are both locked and cannot be removed from the adapter 12. When the cartridge/adapter unit is placed on the preparation site 104 of the toner hopper 10, the outer shutter 14 is released from the adapter 12 and fixed on the preparation site 104. When the cartridge/adapter unit is pushed toward the supplying site, the hopper shutter 103 is automatically unlocked and pushed away to clear the hole 101. When the inner shutter 13 is drawn out of the adapter 12 against the friction between the slit 123, the cartridge/adapter unit is automatically locked on the supply site.

What is claimed is:

1. A cartridge unit for supplying powder to a powder receiver, the cartridge unit comprising:

a cartridge for containing powder and having a mouth through which the powder is supplied;

an adapter fixed to the mouth of the cartridge and having a hole through which the powder is supplied and a slit engraved from a side end of the adapter across the hole, the adapter being attachable to the powder receiver;

an inner shutter that can be inserted in the slit of the adapter for shutting the hole; and an outer shutter that can be attached on the outside of the adapter for covering the hole of the adapter.

2. The cartridge unit according to claim 1, where:

a first member is provided on the inner shutter, a second member is provided on the outer shutter, a third member is provided on the adapter and a fourth member is provided on the outer shutter, and the first member engages with the second member, and the third member engages with the fourth member when the adapter is not attached to the powder receiver, whereby the outer shutter and the inner shutter are locked on the adapter.

3. The cartridge unit according to claim 2, where the first member is a handle provided on the front end of the inner shutter, the second member is a handle provided on the front end of the outer shutter, the third member is a T-shaped hook provided on the front end of the adapter, and the fourth member is a notch formed in the front end of the outer shutter.

4. The cartridge unit according to claim 2, where a fifth member is provided on the outer shutter and a sixth member is provided on a preparation site of the powder receiver, and when the adapter is attached to the preparation site, the fifth member engages with the sixth member, whereby the position of the adapter with the cartridge is fixed and the outer shutter is locked on the preparation site.

5. The cartridge unit according to claim 4, where the fifth member is a hole provided in the outer shutter and the sixth member is a protrusion provided on the floor of the preparation site of the powder receiver.

6. The cartridge unit according to claim 4, where a seventh member is provided on the preparation site of the powder receiver, and when the adapter is attached to the preparation site, the third member engages with the seventh member and the third member is disengaged from the fourth member of the outer shutter, whereby the outer shutter is released from the adapter.

7. The cartridge unit according to claim 6, where the seventh member is a table formed on the front end of the floor of the preparation site of the powder receiver.

8. The cartridge unit according to claim 4, where a seventh member is provided on the preparation site of the powder receiver, and when the adapter is attached to the preparation site, the third member engages with the seventh member and the third member is disengaged from the fourth member of the outer shutter and the third member engages with the first member, whereby the inner shutter is locked in the adapter.

9. The cartridge unit according to claim 8, where the third member slides on the outer shutter which is locked on the preparation site when the adapter is moved from the preparation site to a supplying site of the powder receiver adjacent to the preparation site.

10. The cartridge unit according to claim 6, where an eighth member is provided on the adapter, a ninth member is provided on the outer shutter and a tenth member is provided on a supplying site of the powder receiver adjacent to the preparation site, and when the adapter with the cartridge is moved from the preparation site to the supplying site, the eighth member is guided by the ninth member of the outer shutter fixed on the preparation site and then by the tenth member of the supplying site, whereby the adapter with the cartridge is assuredly guided to the supplying site.

11. The cartridge unit according to claim 10, where the eighth member is a side extension extending from either lateral side of the adapter, the ninth member is a guide rail provided at either lateral side of the outer shutter, and the tenth member is a guide rail provided at either side of the floor of the supplying site of the powder receiver.

12. The cartridge unit according to claim 10, where a third shutter having a stiff edge is provided on the supplying site of the powder receiver for shutting a hole for admitting powder in the powder receiver, and the third shutter is pushed by the outer shutter with the stiff edge being guided by the tenth member when the adapter is moved from the preparation site to the supplying site.

13. The cartridge unit according to claim 8, where a third shutter is provided on the supplying site of the powder receiver for shutting a hole for admitting powder in the powder receiver, an elventh member is provided on the third shutter and a twelfth member is provided on the supplying site of the powder receiver, and the eleventh member is engaged with the twelfth member, whereby the third shutter is locked on the supplying site of the powder receiver.

14. The cartridge unit according to claim 13, where the eleventh member is a notch formed at the front end of the third shutter and the twelfth member is a resilient claw provided at the front end of the floor of the supplying site of the powder receiver.

15. The cartridge unit according to claim 13, where a thirteenth member is provided on the adapter, and when the adapter with the cartridge is moved from the preparation site to the supplying site, the thirteenth member engages with the twelfth member and the twelfth member is disengaged from the eleventh member, whereby the third shutter is released.

16. The cartridge unit according to claim 15, where the thirteenth member is a leading protrusion formed at the rear end of the adapter.

17. The cartridge unit according to claim 15, where a fourteenth member is provided on the adapter and a fifteenth member is provided on the third shutter, and the fourteenth member engages with the fifteenth member when the adapter is moved from the supplying site to the preparation site, whereby the third shutter is dragged by the adapter to shut the hole of the powder receiver.

18. The cartridge unit according to claim 17, where the fourteenth member is an angle provided at the rear edge of the adapter and the fifteenth member is an angle provided at the front edge of the third shutter.

19. The cartridge unit according to claim 9, where a sixteenth member is provided on the outer shutter, and when the adapter is located at the supplying site of the powder receiver, the third member engages with the sixteenth member of the outer shutter fixed on the preparation site and is disengaged from the first member of the inner shutter, whereby the inner shutter is released and can be drawn from the slit of the adapter.

20. The cartridge unit according to claim 19, where the sixteenth member is a notch formed at the rear end of the outer shutter.

21. The cartridge unit according to claim 19, where a seventeenth member is provided on the outer shutter, an eighteenth member is provided on the adpater, and a nineteenth member is provided on the inner shutter, and when the adapter is located at the supplying site of the powder receiver and the inner shutter is drawn out from the adapter, the seventeenth member engages with the eighteenth member, whereby the adapter is locked on the supplying site, and when the adapter is located at the supplying site of the powder receiver and the inner shutter is in the adapter, the nineteenth member engages with the seventeenth member and the seventeenth member is disengaged from the eighteenth member, whereby the adapter is released.

22. The cartridge unit according to claim 21, where the seventeenth member is a cantilever provided at the rear end of the outer shutter, the eighteenth member is a recess formed at the front end of the adapter, and the nineteenth member is a foot projecting downward from the front end of the inner shutter.

23. A cartridge unit for supplying powder to a powder receiver, the cartridge unit comprising:

a cartridge for containing powder and having a mouth through which the powder is supplied;

an adapter fixed to the mouth of the cartridge and having a hole through which the powder is supplied, the adapter being attachable to the powder receiver;

a sealing member attached to the adapter for shutting the hole of the adapter; and an outer shutter that can be attached on the outside of the adapter for covering the hole of the adapter, where a third shutter is provided on a supplying site of the powder receiver for shutting a hole for admitting powder in the powder receiver, a 20th member is provided on the third shutter and a 21st member is provided on the supplying site of the powder receiver, and the 20th member is engaged with the 21st member, whereby the third shutter is locked on the supplying site of the powder receiver.

24. The cartridge unit according to claim 23, where the 20th member is a notch formed at the front end of the third shutter and the 21st member is a resilient claw provided at the front end of the floor of the supplying site of the powder receiver.

25. The cartridge unit according to claim 23, where a 22nd member is provided on the adapter, and when the adapter with the cartridge is moved from the preparation site to the supplying site, the 22nd member engages with the 21st member and the 21st member is disengaged from the 20th member, whereby the third shutter is released.

26. The cartridge unit according to claim 25, where the 22nd member is a leading protrusion formed at the rear end of the adapter.

27. The cartridge unit according to claim 25, where a 23rd member is provided on the adapter and a 24th member is provided on the third shutter, and the 23rd member engages with the 24th member when the adapter is moved from the supplying site to the preparation site, whereby the third shutter is dragged by the adapter to shut the hole of the powder receiver.

28. The cartridge unit according to claim 27, where the 23rd member is an angle provided at the rear edge of the adapter and the 24th member is an angle provided at the front edge of the third shutter.

29. The cartridge unit according to claim 23, where the sealing member is an inner shutter inserted in a slit provided in the adapter across the hole, the inner shutter being able to pull out from the slit.

* * * * *